United States Patent [19]

Walker et al.

[11] Patent Number: 4,715,721

[45] Date of Patent: Dec. 29, 1987

[54] TRANSPORTABLE INTEGRATED BLENDING SYSTEM

[75] Inventors: Lonnie R. Walker; Leslie N. Berryman; Larry E. Guffee, all of Duncan; David E. Ripley, Marlow; David A. Prucha, Duncan, all of Okla.

[73] Assignee: Halliburton Company, Duncan, Okla.

[21] Appl. No.: 757,112

[22] Filed: Jul. 19, 1985

[51] Int. Cl.[4] ..... B01F 15/00

[52] U.S. Cl. ..... 366/132; 114/72; 222/135; 366/134; 366/152; 366/177

[58] Field of Search ..... 366/10, 14, 15, 16–20, 366/27–29, 30, 33, 34, 40, 51, 42, 53, 64, 76, 77, 131, 132, 134, 152, 177, 154, 189–191, 601, 606; 114/72, 73, 74 R; 222/135, 77, 164, 234, 236; 137/101.19, 88; 364/172

[56] References Cited

U.S. PATENT DOCUMENTS

| | | | |
|---|---|---|---|
| 3,172,175 | 3/1965 | Hartley | 366/17 X |
| 3,606,036 | 9/1971 | Beebe et al. | 114/72 X |
| 3,625,724 | 9/1968 | Alvero | 366/10 X |
| 3,670,923 | 6/1972 | Hawes, Jr. et al. | 366/17 X |
| 4,265,266 | 5/1981 | Kierbow et al. | 137/101.19 |
| 4,353,482 | 10/1982 | Tomlinson et al. | 222/1 |
| 4,410,106 | 10/1983 | Kierbow et al. | 222/135 |
| 4,427,133 | 1/1984 | Kierbow et al. | 222/77 |
| 4,498,783 | 2/1985 | Rudolph | 366/177 X |
| 4,579,458 | 4/1986 | Ohlson | 366/17 X |

OTHER PUBLICATIONS

U.S. patent application Ser. No. 483,001, filed Apr. 6, 1983, entitled "Apparatus & Method for Mixing a Plurality of Substances" by E. P. Arnold et al., and assigned to Halliburton Company.

U.S. patent application Ser. No. 483,031, filed Apr. 6, 1983, entitled Apparatus and Method for Mixing a Plurality of Substances" by S. F. Crain et al., and assigned to Halliburton Company.

U.S. patent application Ser. No. 687,094, filed Dec. 28, 1984, entitled "Transportable Material Conveying Apparatus" by L. N. Berryman et al., and assigned to Halliburton Company.

*Primary Examiner*—Timothy F. Simone

*Attorney, Agent, or Firm*—James R. Duzan

[57] ABSTRACT

An integrated blending system comprises a mixing subsystem and a particulate material conveying subsystem which introduce materials into a blender subsystem for producing a blend which is pumped into a well through a pumping subsystem. The subsystems are mounted on a single transportation vehicle at fixed relative positions to each other.

16 Claims, 19 Drawing Figures

TRANSPORTABLE INTEGRATED BLENDING SYSTEM

BACKGROUND OF THE INVENTION

This invention relates generally to systems for storing, conveying and metering at least one substance used in producing a blend of material, and more particularly, but not by way of limitation, to an ocean-going integrated system for producing a fracturing fluid blend and for pumping the blend into an offshore well.

In the oil and gas industry, it is well known that in creating an oil or gas well various fluids or flowable blends need to be prepared for pumping downhole to accomplish different, known purposes. In hydraulically fracturing a selected formation within a well, a fracturing fluid, comprising a selectable combination of substances or materials, needs to be produced and pumped downhole. For example, a liquid gel concentrate might be mixed with selectable ones of several known additives to produce a mixture which is then blended with sand or other particulate material, preferred to as a proppant, to produce the fracturing blend which is to be pumped downhole. Such a blend is prepared at the well site, which requires storage facilities for storing the substances to be mixed and blended, equipment for mixing and blending the substances, and equipment for pumping the resultant blend into the well.

The need for such fluids and the equipment for producing and pumping such fluids has been recognized and has, to some degree, been met by individual pieces of equipment which are separately transported to a common site for use collectively in producing and pumping the blend. Mixing and blending equipment are described in U.S. patent application Ser. No. 483,001, Apparatus and Method for Mixing a Plurality of Substances, filed Apr. 6, 1983, now U.S. Pat. No. 4,538,221, and in U.S. patent application Ser. No. 483,031, Apparatus and Method for Mixing a Plurality of Substances, filed Apr. 6, 1983, now U.S. Pat. No. 4,538,222. A proppant conveying system is described in U.S. patent application Ser. No. 894,440, filed July 31, 1986, a continuation of U.S. patent application Ser. No. 687,094, Transportable Material Conveying Apparatus, filed Dec. 28, 1984, now abandoned. These patents and this application, which have been assigned to the assignee of the present invention, disclose equipment which has been in public use for more than one year. These patents and this application are incorporated herein by reference both for the background and prior art disclosures made therein of pertinence to the present invention and for the disclosure of equipment exemplifying the type of individual elements which can be adapted for use in the present invention.

One shortcoming of the aforementioned prior art is that many separate pieces of equipment must be separately transported and assembled together for each fracturing, or other type of fluid preparation and pumping, job. This requires maintaining logs of the individual pieces of equipment to insure that suitable ones will be available when needed. This also requires repeated assembly and disassembly of the separate elements from job to job. Therefore, there is the need for an integrated system in which all necessary materials or substances can be stored, mixed, blended and pumped without the need to individually collect, assemble and disassemble separate pieces of equipment for each fluid producing and pumping job. This need contemplates that the original construction of the overall system is to include the use of a single transportation vehicle so that all of the equipment of the system can be fixed to the vehicle and simultaneously transported thereby.

The foregoing need has become particularly critical for offshore drilling operations where it may be even more inefficient to try to assemble on the offshore drilling platform, or to provide from a number of floating vessels, the type of storage, conveying and metering system necessary to properly produce and pump a blend into an offshore well. Therefore, there is the more particular need for an ocean-going integrated system which can be readily moved from one offshore well to another to provide the entire means necessary to produce a selectable type of blend.

SUMMARY OF THE INVENTION

The present invention overcomes the above-noted and other shortcomings of the prior art by providing a novel and improved transportable integrated blending system. The integrated system provides storage, conveying and metering facilities from a fixed assembly of equipment simultaneously and commonly transportable. In a preferred embodiment, the system is specifically adapted for offshore use in producing and pumping fracturing blends from the fixed assembly of equipment into an offshore well.

Broadly, the integrated system of the present invention comprises blend means for producing a blend to be pumped into a well; holding storage means for storing a substance; surge storage means for receiving at least a portion of the substance from the holding storage means; means for conveying the substance from the holding storage means to the surge storage means; means for transferring the substance from the surge storage means to the blend means; and transport means, having the aforementioned means mounted thereon, for simultaneously transporting the aforementioned means to the well. The system further comprises mixing means, mounted on the transport means, for producing a mixture of at least two other substances and for providing the mixture to the blend means. The system still further comprises pump means, mounted on the transport means, for pumping the blend from the blend means to the well.

Therefore, from the foregoing, it is a general object of the present invention to provide a novel and improved transportable integrated blending system. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
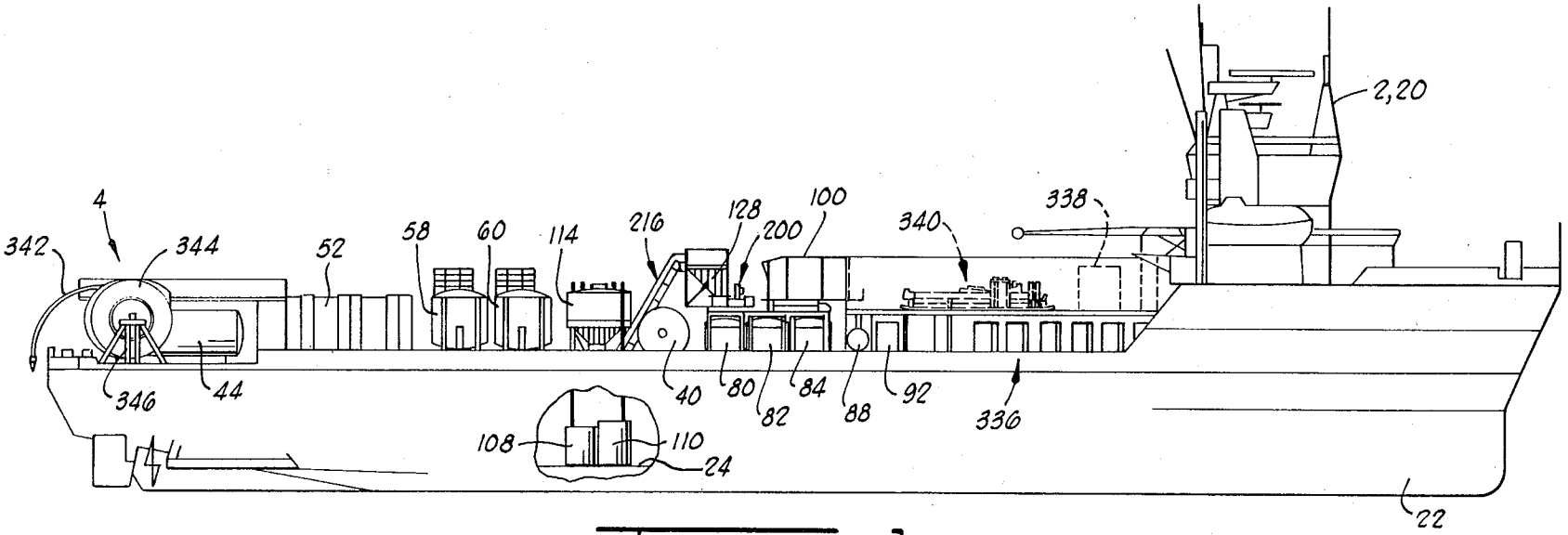
FIG. 1 is a partially schematic elevational view of the preferred embodiment of the present invention.

With reference initially to FIGS. 1–4, the general construction of the preferred embodiment of the present invention will be described. The preferred embodiment includes a transport means 2 for transporting the system of the present invention from one site to another. Integrally associated with the transport means 2 is a blend producing and pumping facility 4 shown in FIG. 4 as including a blender subsystem 6 for blending substances received from a mixing subsystem 8 and a proppant subsystem 10. The blender subsystem 6 provides an output which is flowed by a pumping subsystem 12 into an offshore well 4 located in the floor 16 beneath a body of water 18 upon which the transport means 2 can float.

The transport means 2 of the preferred embodiment is specifically some type of floatable means for transporting the system on the water 18, such as an ocean-going ship 20 used as a stimulation vessel of types as known to the art. More generally, the transport means 2 is any suitable unitary vehicle capable of simultaneously supporting and transporting the elements of the blend producing and pumping facility 4 as an integrated unit from location to location.

The ship 20 has a hull 22 including a lower support surface or deck 24 and an upper support surface or deck 26. The deck 26 is spaced sufficiently above the deck 24 so that some type of chamber or hold is defined therebetween. The deck 24 defines one tier and the deck 26 defines another tier of the overall combination of the present invention. Still another tier of the present invention is defined above the deck 26 by support elements as described hereinbelow.

Figure 2:
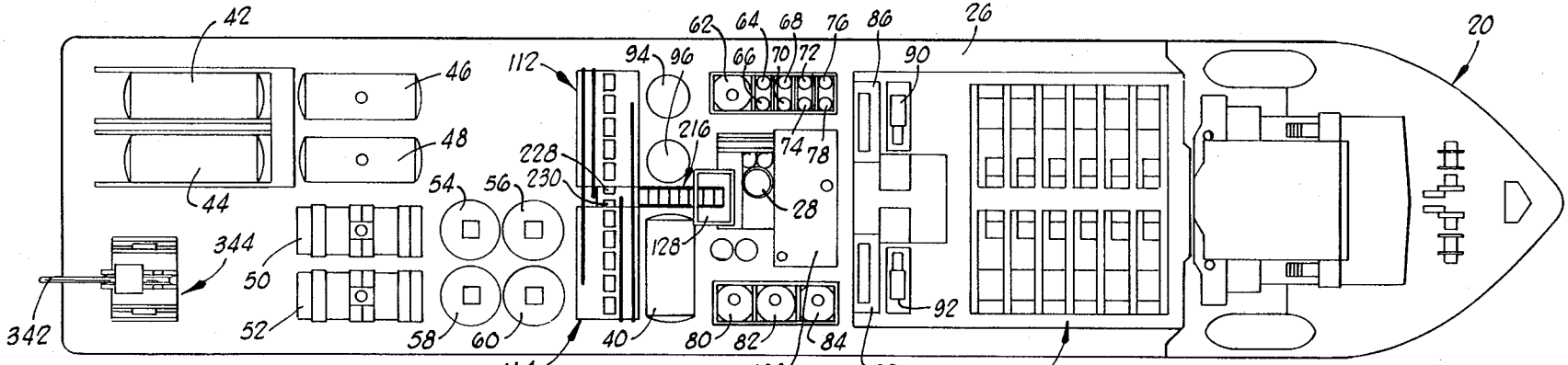
FIG. 2 is a partially schematic plan view of one tier of the preferred embodiment of the present invention.
Figure 6:
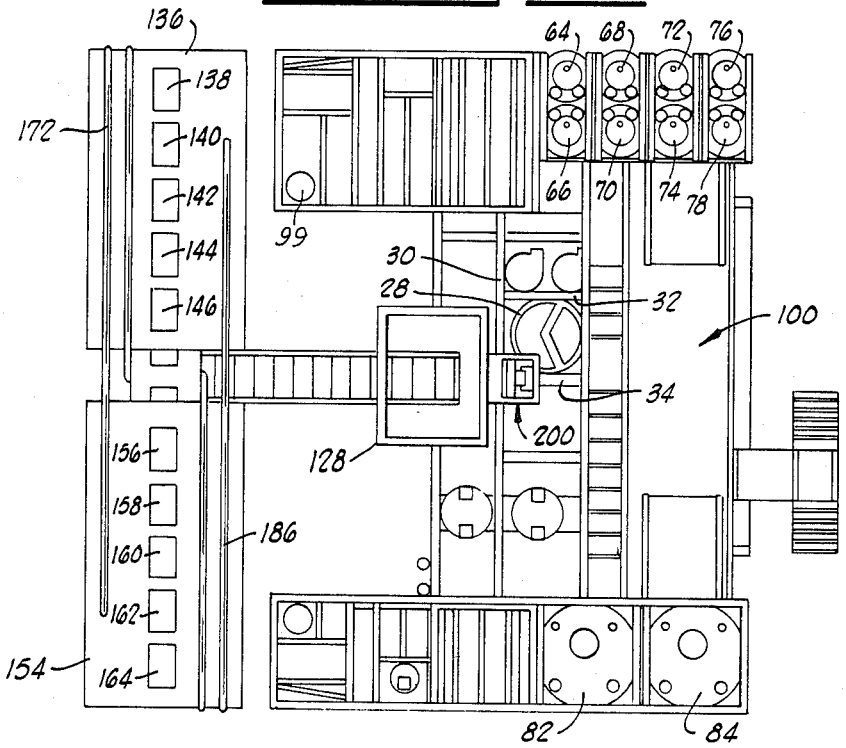
FIG. 6 is a plan view of the portions shown in FIG. 5.

The blending subsystem 6 of the preferred embodiment, best viewed in FIGS. 2 and 6, includes a blender tub 28 of a type as known to the art. The tub 28 is connected by a suitable support means shown as a framework 30 in FIG. 6. The framework 30 is attached to the deck 26 by a suitable means, such as by a pinning mechanism described in copending U.S. patent application entitled Close Tolerance Pin Connection and assigned to the assignee of the present invention, concurrently filed herewith. The support means 30 supports the tub 28 near the bottom of the framework; that is, the tub 28 sits on the bottom portion of the framework 30 which is a modularly constructed skid unit extending upwardly from the lower elements defining the skid to upper support elements such as identified by the reference numerals 32, 34 shown in FIG. 6. As shown in FIG. 2, the tub 28 is located near the center of the ship 20.

Associated with the tub 28 is a mechanical agitation system for agitating the contents of the tub 28 at variable speeds. Such a mechanical agitation system is of a type as shown to the art.

Figure 4:
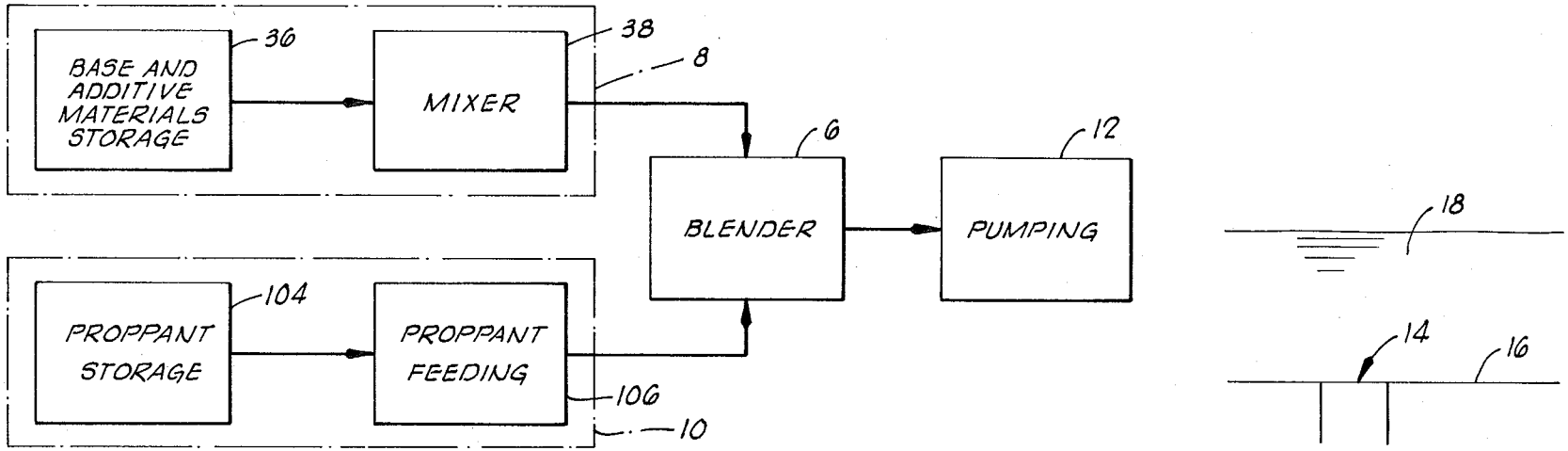
FIG. 4 is a functional block diagram of part of the preferred embodiment of the present invention.

Part of what the tub 28 receives for creating the blend which is output through the pumping subsystem 12 is a mixture of substances received from the mixing subsystem 8. FIG. 4 shows that the subsystem 8 broadly includes a base and additive material storage portion 36 and a mixer portion 38. The elements of this subsystem are of types as known to the art; examples of such elements which can be adapted for use in the present invention are described in U.S. Pat. No. 4,538,221 and U.S. Pat. No. 4,538,222 both of which application are incorporated herein by reference.

Figure 3:
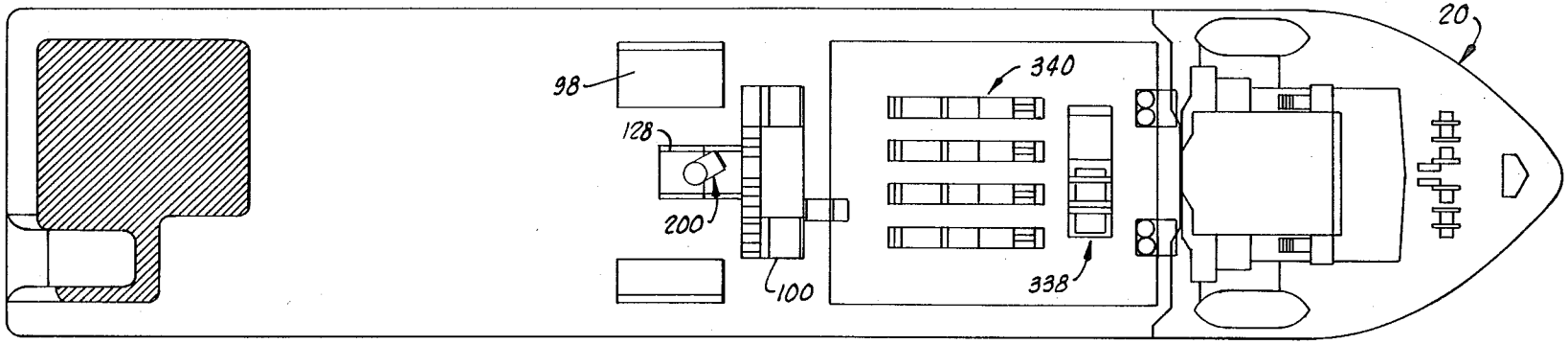
FIG. 3 is a partially schematic plan view of a second tier of the preferred embodiment of the present invention.

The base and additive materials storage portion 36 of the subsystem 8 is shown in FIGS. 1–3 as including a plurality of tanks containing fluids and a housing containing dry additives, which can be controllably placed into the mixer portion 38 for preparing a suitable mixture to be flowed into the tub 28 or which can otherwise be added to produce the ultimate fracturing fluid provided by the preferred embodiment.

The base material to be stored in the portion 36 of the illustrated embodiment is a liquid gel concentrate contained in a storage or holding tank 40 connected to the deck 26 amidships near the tub 28. Primary tanks (not shown) for feeding into the tank 40 can be mounted on the deck 24.

Fluid additives are contained along the deck 26. Commencing at the stern, FIGS. 1 and 2 disclose storage tanks 42, 44 containing liquid nitrogen, which in the preferred embodiment is to be vaporized and pumped into the blend as it is pumped out of the pumping subsystem 12. Moving forward away from this location, FIGS. 1 and 2 show tanks 46, 48, which are for storing methanol, tanks 50, 52, 54, 56, 58, 60, which are for storing acid, and tanks 62, 64, 66, 68, 70, 72, 74, 76, 78, 80, 82, and 84 which are for storing liquid additives. The methanol and acid are to be added at the output of the blender subsystem 6, and the liquid additives are to be mixed with the liquid gel concentrate in the mixer portion 38 or as the blend is pumped out of the blender subsystem 6. Each of the tanks 40-84 is individually, or together with related tanks, skid-mounted for pinned coupling to pads connected to the deck 26 similarly to the skid mounting of the tub 28. Also suitably disposed on the deck 26 in association with the nitrogen tanks 42, 44, but spaced therefrom, are nitrogen vaporizers 86, 88 and nitrogen pumps 90, 92. The aforementioned elements are of suitable types as known to the art.

As previously mentioned, the contents of the tanks 40–84 are suitably flowed to appropriate points for producing the ultimate flow pumped downhole. For example, the liquid gel concentrate and selectable ones of the liquid additives are flowed into batch mixer tubs 94, 96 for mixing by suitable mixing apparatus contained therein as known to the art. The mixture created within the tubs 94, 96 can be provided to the blender tub 28. This flow control is not a part of the present invention, but rather it is the subject of copending U.S. patent application entitled Integrated Blending Control System, filed concurrently herewith, assigned to the assignee of the present invention and incorporated herein by reference.

Also forming a part of the storage portion 36 is a housing 98 located on the tier defined by the upper structure of the skid frameworks containing the additive tanks 62–78. Stored within the storage house 98 are sacks of dry additives which can be dumped through openings (e.g., opening 99 shown in FIG. 6) of the housing floor directly into the mixer tubs 94, 96.

Figure 5:
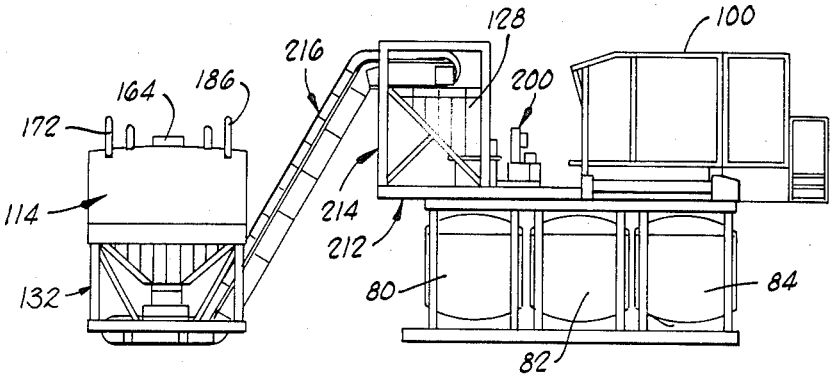
FIG. 5 is an elevational view showing part of proppant storage and proppant feeding portions of the preferred embodiment of the present invention.

To control the flow of fluids into the tubs 94, 96, there is provided within the system of the present invention a microprocessor based control system disposed within a control housing 100, best seen in FIGS. 1 and 5. The control system has a control panel 102 of the type shown in FIG. 18 associated therewith. The details of the control panel 102 will not be described herein because they are similar to the related control panel disclosed in the previously mentioned patents, U.S. Pat. No. 4,538,221 and U.S. Pat. No. 4,538,222, which have been incorporated herein by reference. The control panel 102 provides real time, continuous control over the mixing subsystem 8. Also associated with the control housing 100 is a laminar rheology flow loop of known type providing real time measurements of fluid properties for controlling the quality of the base gel and for predicting bottom hole treating pressures as known to the art.

Although not shown in the drawings for purposes of simplicity, suitable piping is provided through which the fluids can be conveyed to their appropriate locations. Such piping interconnections would be readily understood and known to those in the art.

Also providing material to the blender tub 28 is the proppant subsystem 10 shown in FIG. 4 as broadly including a proppant storage portion 104 and a proppant feeding portion 106.

The proppant storage portion 104, shown in FIGS. 1, 2 and 5–7, provides a source of particulate materials, such as sand, which is to be added to the mixture through the action of the agitation within the blender tub 28. In the preferred embodiment the proppant storage portion 104 has two levels of storage, both structurally and functionally. One level of storage includes bins 108, 110 (FIG. 1) for storing a reserve quantity of the proppant material. As shown in FIG. 1, the bins 108, 110 are disposed or positioned on the lower deck 24. In the preferred embodiment the bin 108 is located on the port side, and the bin 110 is located on the starboard side. The other level within the storage portion 104 is provided by bins 112, 114, mounted on the upper deck 26, having a plurality of storage compartments 116, 118, 120 and 122, 124, 126, respectively. The bins 112, 114 provide a storage interface between the bins 108 and 110 and a surge bin 128 forming part of the proppant feeding portion 106 described hereinbelow.

The bins 112, 114 are skid-mounted on support structures 130, 132, respectively. The structures 130, 132 are suitably fixed to the deck 26 so that the bins 112, 114 are in fixed spatial relationship relative to each other and relative to a gathering conveyor 134 forming another part of the feeding portion 106 as further described hereinbelow.

The bin 112 has a cover 136 disposed on the top thereof. Five hatches 138, 140, 142, 144, 146 are suitably retained on the cover 136. The bin 112 also has controllable outlets 148, 150, 152 disposed above the base of the support structure 130. Each outlet is associated with a respective one of the compartments 116, 118, 120. The outlets 148, 150, 152 have suitable valves of a type as known to the art associated therewith. The hatches 138, 140, 142, 144, 146 are aligned and the outlets 148, 150, 152 are aligned, and the bin 112 is affixed to the deck 26 so that these alignments extend perpendicularly to the length of the vessel 20.

The bin 114 is constructed similarly to the bin 112 in that it comprises a similar cover 154 having hatches 156, 158, 160, 162, 164 retained thereon and having outlets 166, 168, 170, each of which communicates with a respective one of the compartments 122, 124, 126. The outlets 166, 168, 170 are spaced above the base of the support structure 132. The hatches 156, 158, 160, 162, 164 and the outlets 166, 168, 170 are aligned so that their alignments extends perpendicularly to the length of the vessel 20. The bin 112 and the bin 114 are aligned similarly but spaced on opposite sides of the central conveyor of the gathering conveyor 134.

Communicating the particulate material from the lower reserve bin 108 to the compartments 116, 118, 120, 122, 124, 126 is a suitable conduit means including a pipe 172 extending from the bin 108 through the deck 26 to a location extending over the covers 136, 154 and the compartments located therebelow. The pipe 172 terminates in communication with the compartments 116, 118, 120, 122, 124, 126 through pipe outlets 174, 176, 178, 180, 182, 184, respectively. The pipe 172 and its associated outlets define a flow path through which the substance contained in the bin 108 can flow to the compartments 116–126.

Communicating the bin 110 with the compartments of the bins 112, 114 is another conduit means including a pipe 186 having pipe outlets 188, 190, 192, 194, 196, 198 extending downwardly into fluid communication with the compartments 126, 124, 122, 120, 118, 116, respectively. The pipe 186 extends through the deck 26 to an overlying position above the covers 136, 154 in a manner similar to the pipe 172 except that the pipe 186 comes up from the starboard side of the bins 112, 114 as opposed to the port side rise of the pipe 172.

The proppant feeding portion 106 has been previously mentioned as including a surge bin 128 and a gathering conveyor 134. The portion 106 also includes a metering conveyor 200 defining means for transferring a controllable quantity of the material received in the surge bin 128 to the blender tub 28. The portion 106 broadly includes equipment similar to that disclosed in the aforementioned U.S patent application Ser. No. 894,440, a continuation of U.S. application Ser. No. 687,094, both of which are incorporated herein by reference.

The surge bin 128 is shown in FIGS. 1–2, 5–7, and 11–13. It is of any suitable construction for receiving at least a portion of the particulate material from the bins 112, 114 and temporarily holding the contents to insure an adequate supply to the metering conveyor 200 so that the proper amount of the material can be added into the blender tub 28. A detailed description of a suitable surge bin is given in the aforementioned U.S. patent application Ser. No. 687,094 and its continuation, U.S. patent application Ser. No. 894,440.

Figure 11:
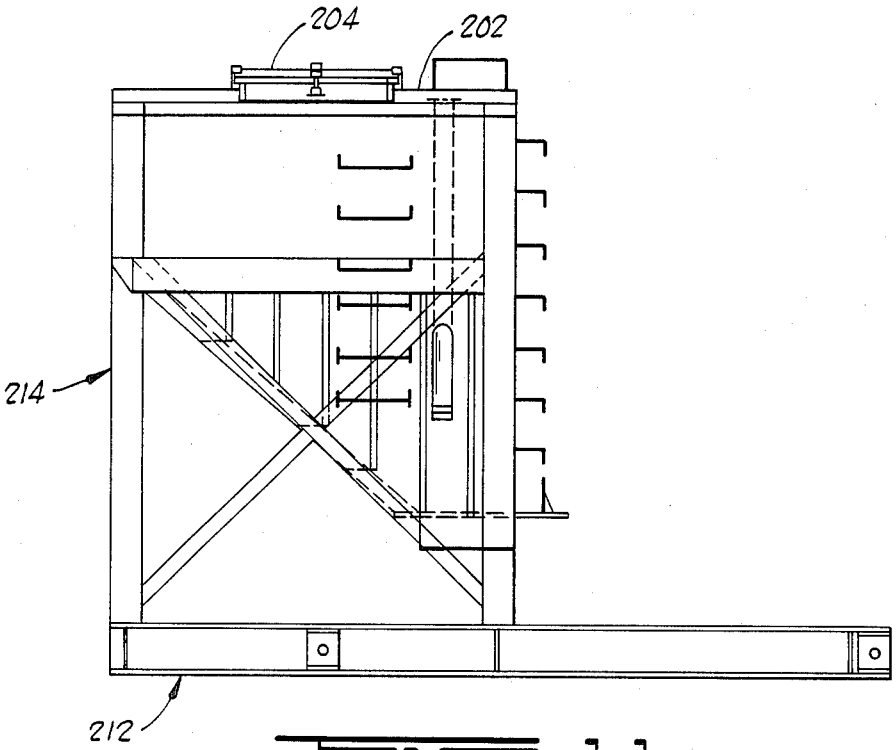
FIG. 11 is an elevational view of a surge bin of the proppant feeding portion of the preferred embodiment of the present invention.
Figure 12:
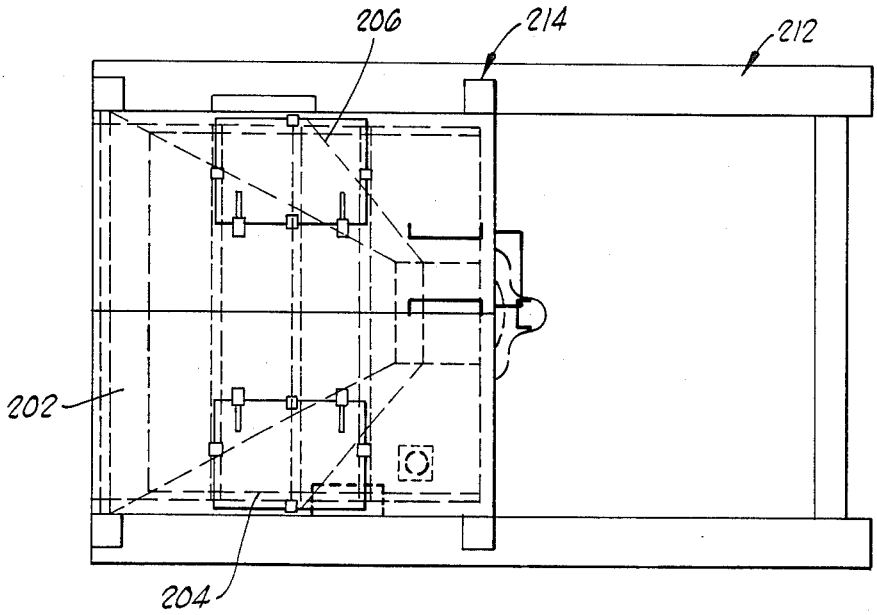
FIG. 12 is a plan view of the surge bin shown in FIG. 11.
Figure 13:
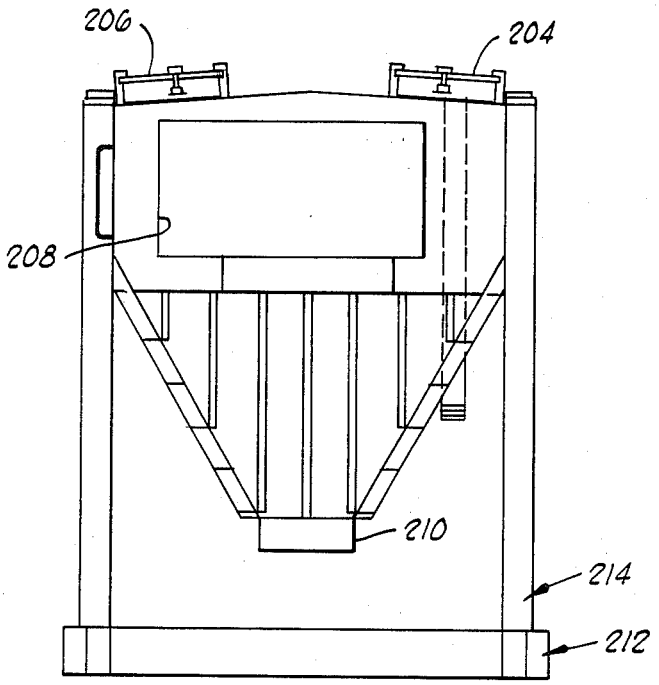
FIG. 13 is another elevational view of the surge bin shown in FIG. 11.

The surge bin 128 shown in FIGS. 11–13 includes a cover 202 having hatches 204, 206. Defined through a side wall of the bin 128 is an opening 208 for receiving an upper portion of a central conveyor within the gathering conveyor 134. This provides an inlet to the bin 128. An outlet 210 for providing communication with the metering conveyor 200 is disposed at the bottom of the bin 128. The bin 128 is supported on top of the supporting framework 30, which contains the blender tub 28 by a suitable support means comprising a base 212 and an upper framework 214. The base 212 is suitably connected to the lower module containing the tub 28 as best shown in FIGS. 1 and 5. With the surge bin 128 so connected, it is disposed at a height above the tub 28 which facilitates dumping of the material from the bin 128 into the tub 28 through operation of the metering conveyor 200.

Figure 9:
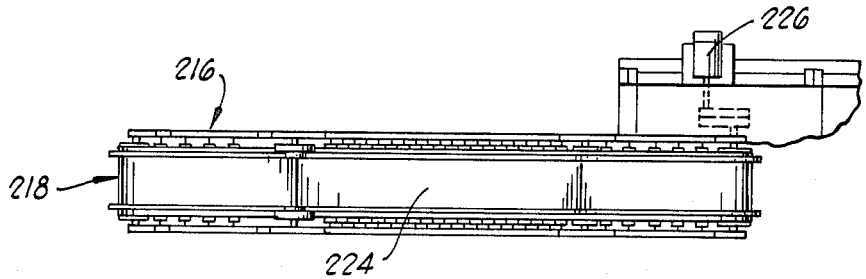
FIG. 9 is a plan view of the trunk conveyor shown in FIG. 8.
Figure 10:
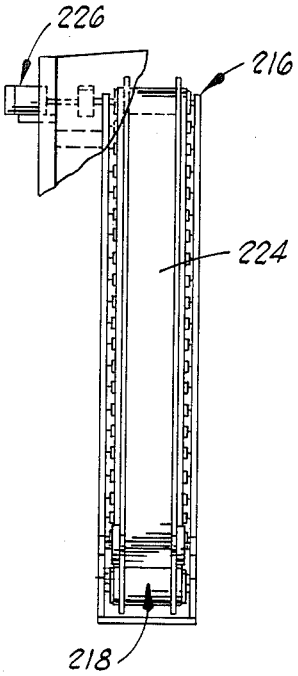
FIG. 10 is another elevational view of the trunk conveyor shown in FIG. 8.
Figure 8:
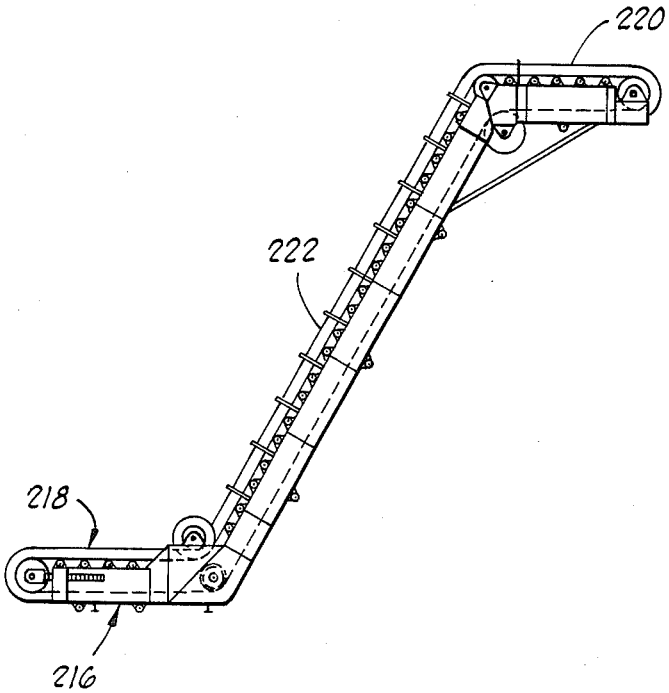
FIG. 8 is an elevational view of a trunk conveyor of a gathering conveyor means of the proppant feeding portion of the preferred embodiment of the present invention.

To move the contents of the bins 112, 114 into the surge bin 128, there is provided the gathering conveyor 134. The gathering conveyor 134 includes a central or trunk conveyor 216 particularly illustrated in FIGS. 8–10. The trunk conveyor 216 is a suitable belt-type conveyor in the preferred embodiment having a lower horizontal section 218, an upper horizontal section 220 and an elevating, intermediate section 222 extending angularly between the portions 218, 220. The portion 220 is received in the opening 208 of the surge bin 128 as best seen in FIGS. 5 and 6. The lower portion 218 is disposed between the aligned bins 112, 114. The central conveyor 216 includes a belt 224 which s rotated through appropriate couplings by a motor 226 in a manner as known to the art.

Figure 7:
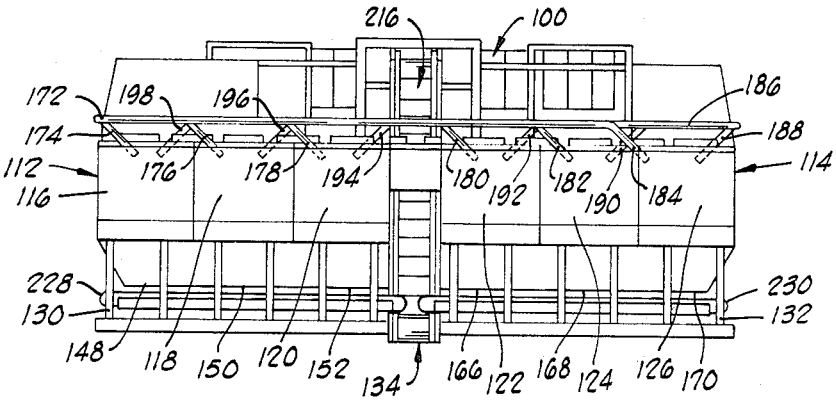
FIG. 7 is another elevational view of the portions shown in FIG. 5.

Forming another part of the gathering conveyor 134 are branch conveyors 228, 230 best seen in FIG. 7. The branch conveyors 228, 230 are of suitable constructions as known to the art. The conveyor 228 extends linearly in fixed relationship below the outlets 148, 150, 152 of the compartments of the bin 112. One end of the conveyor 28 is disposed in fixed overlying relationship with the lower horizontal portion 218 of the trunk conveyor 216. The conveyor 230 extends in similar fixed relationships relative to the outlets 166, 168, 170 of the compartments of the bin 114 and with respect to the trunk conveyor 216 as also known in FIG. 7.

Figure 14:
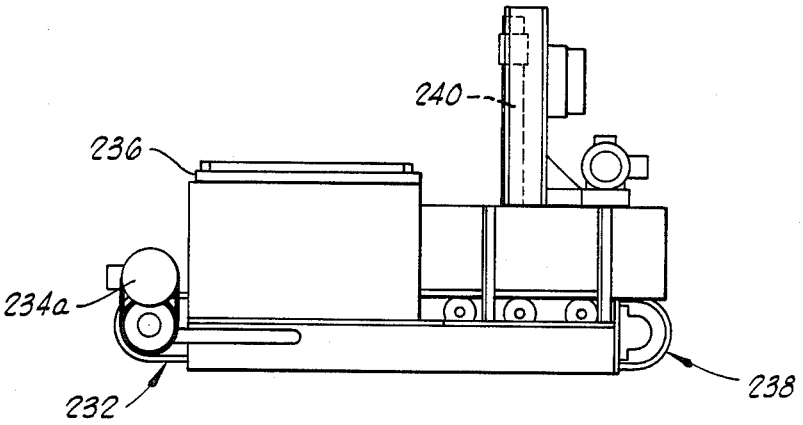
FIG. 14 is an elevational view of a metering conveyor of the proppant feeding portion of the preferred embodiment of the present invention.
Figure 15:
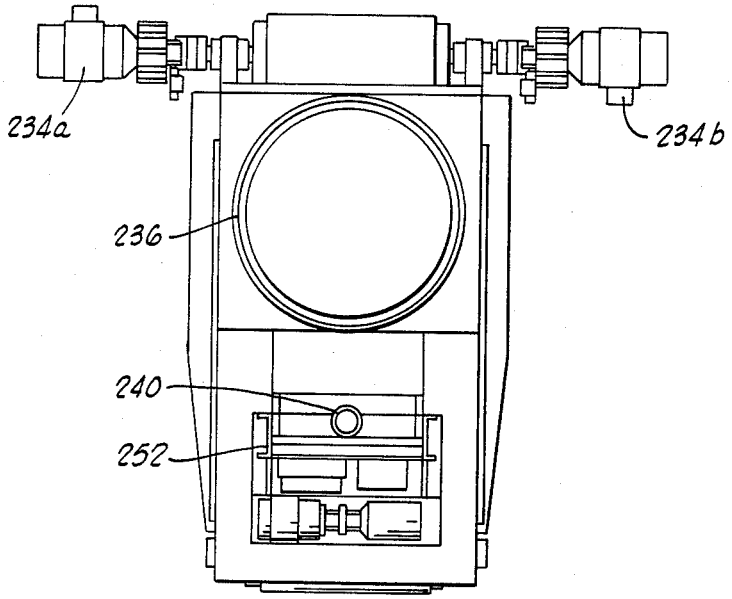
FIG. 15 is a plan view of the metering conveyor show in FIG. 14.
Figure 16:
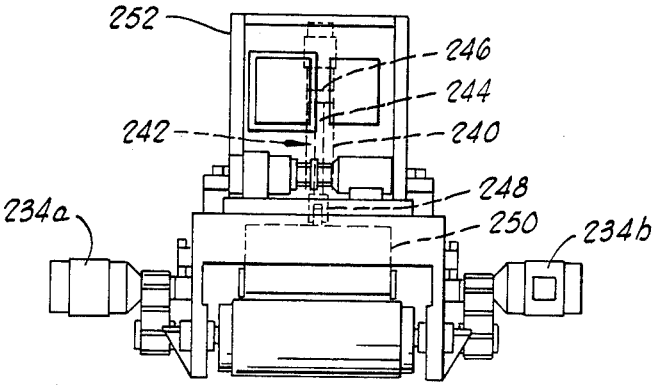
FIG. 16 is another elevational view of the metering conveyor shown in FIG. 14.

Once the material has been moved into the surge bin 128 through operation of the gathering conveyor 134, the material is then controllably transferred into the tub 28 through operation of the metering conveyor 200. FIGS. 14–16 show that the preferred embodiment of the metering conveyor 200 includes a suitable conveyor belt mechanism 232, such as one of the type disclosed in the aforementioned U.S. patent application Ser. No. 687,094 and its continuation, U.S. patent application Ser. No. 894,440. The conveyor 232 includes drive motors **234*a*, 234*b*, which are responsive to suitable control signals from the control house 100. The conveyor belt mechanism 232 also includes a turntable jacket 236 which cooperates with the outlet 210 of the surge bin 128 to direct the material onto the belt of the conveyor belt mechanism 232 and to permit pivotation between the surge bin 128 and the metering conveyor 200. This pivotable relationship permits a discharge end 238 of the conveyor belt mechanism 232 to be suitably positioned over the blender tub 28 whereby the proppant transferred by the conveyor belt mechanism 232 properly drops into the tub 28**.

The metering conveyor 200 also includes gate means for adjustably defining an opening adjacent the conveyor belt mechanism 232, through which opening the particulate material must pass before being communicated to the blender tub 28 so that the maximum cross-sectional area of the proppant moved to the end of the conveyor is defined. FIGS. 14–16 show that the gate means includes a piston housing 240 having a piston 242 movably disposed therein. The piston 242 includes a piston rod 244 extending from a piston head 246 located within the housing 240, to an end 248, located outside the housing 240. The gate means also includes a screed 250 suitably connected to the end 248 of the piston rod 244. The gate means still further includes support means 252 for supporting the piston housing 240 above the conveyor belt mechanism 232. The support means 252 and the housing 240 are connected relative to the conveyor belt mechanism 232 so that the screed 250 extends across the belt of the conveyor belt mechanism 232 and is controllably movable to selectable heights above the belt, thereby permitting the maximum cross-sectional area of the quantity of particulate material moved by the conveyor belt mechanism 232 to be variably definable.

Figure 18:
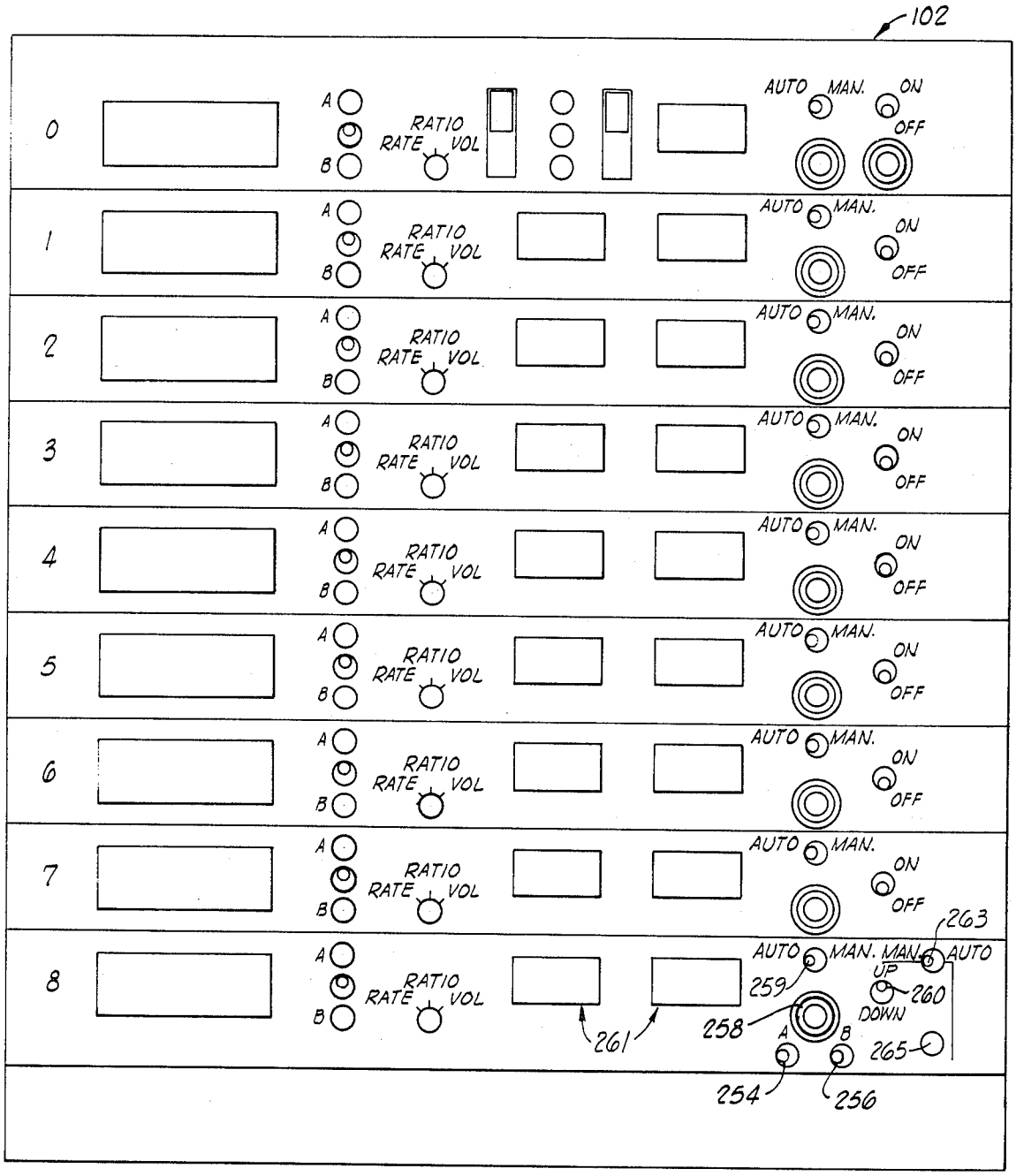
FIG. 18 depicts a control panel for controlling the flow of fluid from a fluid storage portion to a mixer portion and for controlling a gate of the metering conveyor of the preferred embodiment of the present invention.

The motors **234*a*, 234*b* and the gate means are controlled from the control panel 102 shown in FIG. 18. Which of the motors is operative is selected by switches 254, 256. The speed of the motor is selected through a potentiometer 258 when a switch 259 is in a manual mode position or through switches 261 when the switch 259 is in an automatic mode position. The position of the screed 250 of the gate means is adjusted by an up/down switch 260 which continuously controls a hydraulic system connected with the housing 240 when a switch 263 is in a manual mode position or by a switch 265 which discretely controls the hydraulic system to move the screed to a selectable preset height when the switch 263** is in an automatic mode position.

Figure 17A:
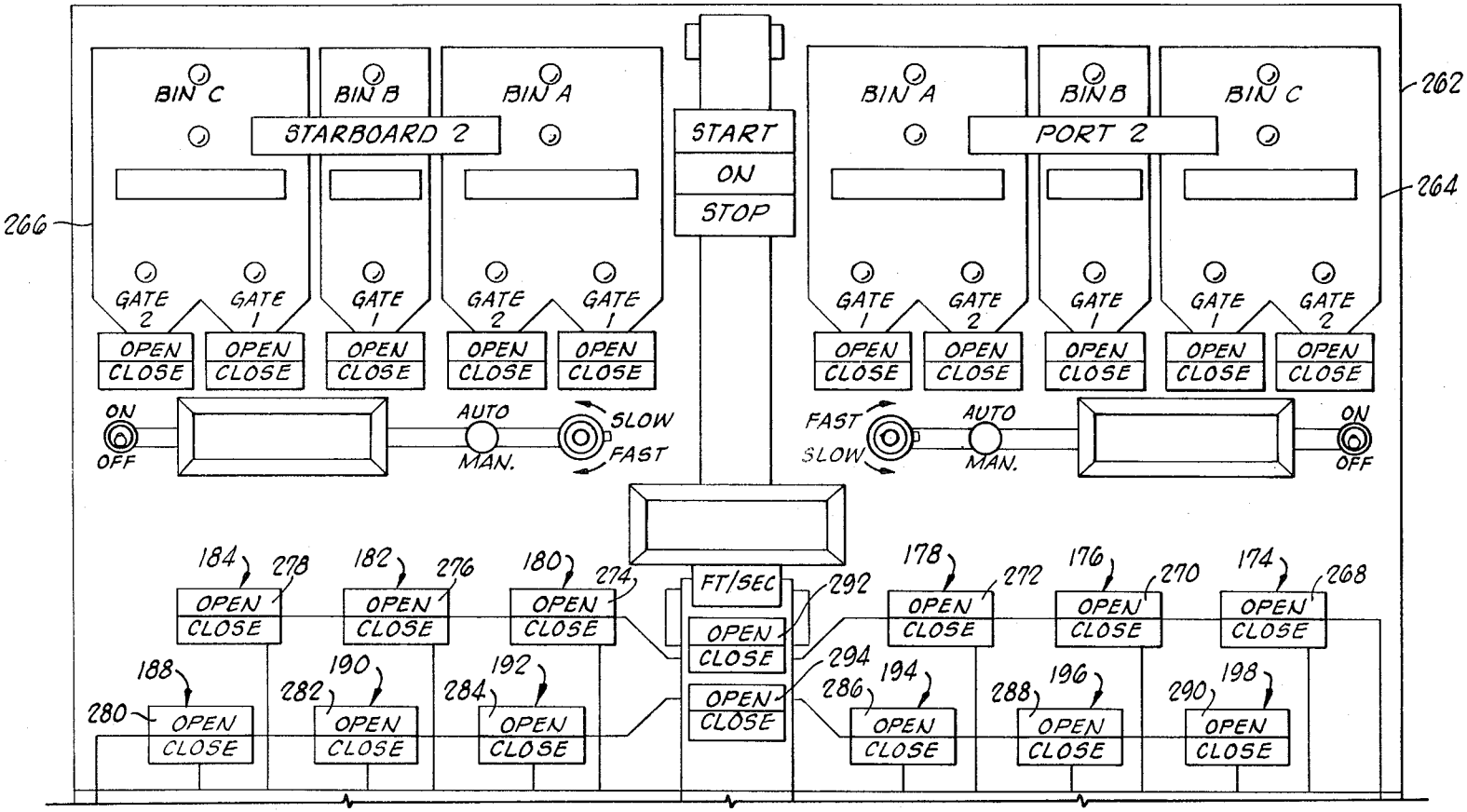
FIGS. 17A–17B depict a control panel for controlling the flow of proppant from the proppant storage portion to the surge bin of the preferred embodiment of the present invention.
Figure 17B:
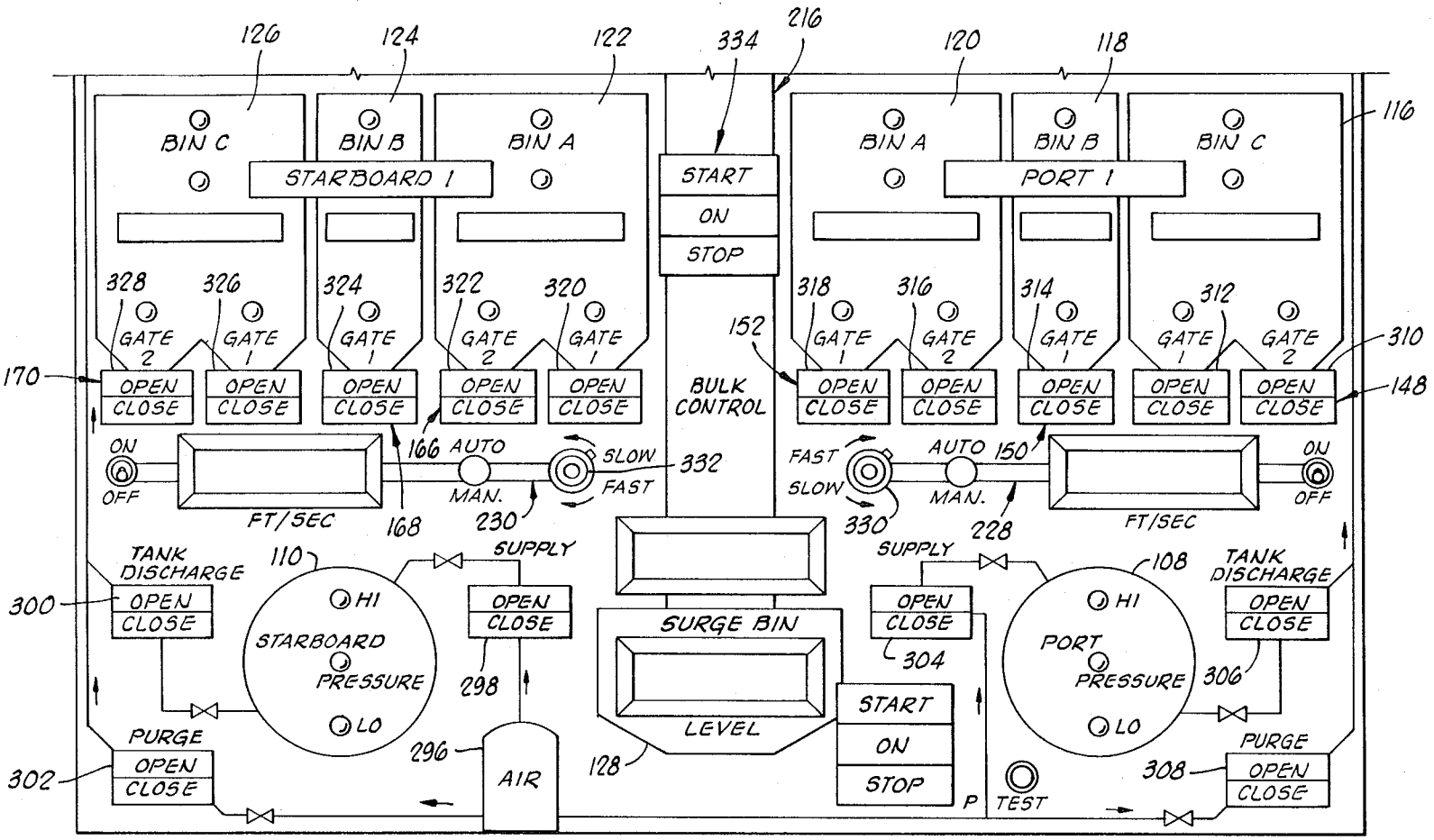

With reference to FIGS. 17A–17B, a control panel 262 located in the control house 100 and used for controlling the transfer of materials through the proppant subsystem 10 into the surge bin 128 will be briefly described; however, neither this control panel 262 nor the control panel 102 is a part of the invention claimed herein. The control system for the invention claimed herein is more particularly described and claimed in copending U.S. Patent Application entitled Integrated Blending Control System, filed concurrently herewith.

The control panel 262 is shown to have a schematic representation of the compartments of the bins 112, 114, the pipe outlets of the conduit means extending from the lower deck reserve bins 108, 110, and the gathering conveyor means as indicated by like reference numerals matching the diagrams on the control panel 262 with their corresponding structures previously described hereinabove. A second level of storage bins 264, 266 is also shown on the control panel 262; however, this level is not shown implemented in FIGS. 1–16 and will not be described, but these diagrams are indicative that the preferred embodiment can be expanded.

FIG. 17A shows that the control panel 262 includes open/close status lights 268, 270, 272, 274, 276, 278 corresponding to the open or closed status of valves respectively associated with the pipe outlets 174, 176, 178, 180, 182, 184. Similar status indicators 280, 282, 284, 286, 288, 290 designate the open or closed status of valves respectively associated with the pipe outlets 188, 190, 192, 194, 196, 198. Indicators 292, 294 designate whether interconnecting valves located in the pipes 172, 186, respectively, between the bins 112, 114 are open or closed. These valves of the preferred embodiment are manually controlled by personnel; however, it is contemplated that remote control can be provided. Switches for effecting such remote control could be incorporated when the indicators 268, 270, 272, 274, 276, 278, 280, 282, 284, 286, 288, 290, 292, 294 to achieve this purpose.

Which of the pipe outlets 174, 176, 178, 180, 182, 184 and 188, 190, 192, 194, 196, 198 is or are opened determines into which of the compartments 116, 118, 120, 122, 124, 126 the proppant material will be dumped upon actuation of the pneumatic transfer system diagrammatically represented in the lower corners of the control panel 262 shown in FIG. 17B. An air supply 296 is represented as providing a souce of air to transfer proppant from both the port bin 108 and the starboard bin 110. Such transfer is controlled by the valves designated in FIG. 17B, the status of which is indicated by indicators 298, 300, 302, 304, 306, 308.

Once material has been loaded into one or more of the compartments 116, 118, 120, 122, 124, 126, transfer therefrom to the surge bin 128 is controlled by appropriately opening or closing the gates at the outlets of the compartments and by appropriately controlling teh speeds of the branch conveyors 228, 230 and the trunk conveyor 216. The gates at the outlets of the compartments include valves which are controlled through switch/indicators 310, 312, 314, 316, 318, 320, 322, 324, 326, 328. It will be noted that the compartments 116, 120, 122, 126 have two gates/valves included within the outlets, whereas the compartments 118, 124 have only a single gate/valve.

The speed of the branch conveyor 228 is controlled by a potentiometer 330, and the speed of the branch conveyor 230 is controlled by a potentiometer 332. The potentiometers 330, 332 set the respective speeds as percentages of the speed of the metering conveyor 200. The trunk conveyor 216 is a constant speed conveyor controlled so that an appropriate amount of material is retained in the surge bin 128 without underfilling or overfilling the surge bin 128. The actuation and deactuation of the trunk conveyor 216 is controlled by switch/indicator 334.

With reference again to FIGS. 1-3, the pumping subsystem 12 will be described. This subsystem provides means for flowing the blended plurality of substances from the tub 28 into the well 14. In the preferred embodiment the pumping subsystem 12 includes drive pump means 336, comprising a plurality of Halliburton Services HT-400 pumps, for providing a driving fluid. The pumps 336 are skid-mounted, modularly constructed assemblies which are suitably mounted on the deck 26. The modules have upper support structures which define at least part of the uppermost tier of the present invention. This uppermost tier has mounted thereon a power fluid cooling system 338 and intensifiers 340. The pressurized driving fluid provided from the pumps 336 is communicated up to the power fluid cooling system 338 which cools, filters and boosts the fluid and provides a power fluid manifold to which the intensifiers 340 are connected. The intensifiers 340 of the preferred embodiment include a plurality of Halliburton Services HT-1000B intensifiers. The intensifiers 340 are connected to the blender tub 28 for pumping the blended plurality of substances in response to the pressurized driving fluid provided by the pumps 336 through the system 338.

The outputs of the intensifiers 340 are communicated with a flexible hose 342 forming part of the Halliburton Services BIG INCH ® discharge manifold mounted on the deck 26 at the stern of the vessel 20. The discharge manifold includes a reel 344 rotatably retained by a structure 346. Remote disconnects are utilized to quickly disconnect from the hose 342 in an emergency.

In operation, the mixing subsystem 8 is suitably controlled through operation from the control panel 102, and the proppant subsystem 10 is appropriately controlled through operation from the control panels 102, 262. The mixture and proppant provided from these subsystems are suitably blended in the blender subsystem 6. The functions of these subsystems and of the elements of which these subsystems are comprised are individually well known to the art for producing a fracturing fluid, in the preferred embodiment, of any suitable type needed for the particular fracturing job. The fracturing fluid is then pumped into the well 14 through the pumping subsystem 12 also utilizing individual pieces of equipment well known to the art. Therefore, although the invididual elements of the present invention may be separately well known to the art, the combination described and claimed herein provides a novel and improved integrated, unitarily transportable blending system which can be readily moved from well site to well site.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A transportable integrated system of components commonly and simultaneously transportable from one location to another, at each of which locations a respective blend of produced from a plurality of substances contained within and transported by the system, said system comprising:

a blend producing facility;

floatable means for transporting said blend producing facility on water to a respective one of the locations; and wherein said blend producing facility includes:

blender means, mounted on said floatable means, for blending a plurality of substances into a respective blend needed at the respective one of the locations;

storage means, mounted on said floatable means, for storing a particulate material defining one of the plurality of substances;

surge bin means, mounted on said floatable means, for receiving at least a portion of the particulate material;

means, mounted on said floatable means, for conveying particulate material from said storage bin means to said surge bin means; and means, mounted on said floatablemeans, for transferring a controllable quantity of the particulate material from said surge bin means to said blender means.

2. A system as defined in claim 1, further comprising:

batch mixer means, mounted on said floatable means, for providing a mixture to said blender means for blending with the particulate material;

first tank means, mounted on said floatable means and connected to said batch mixer means, for storing a first fluid for use by said batch mixer means in providing the mixture; and second tank means, mounted on said floatable means and connected to said batch mixer means, for storing a second fluid for use by said batch mixer means in providing the mixture.

3. A system as defined in claim 2, further comprising means, mounted on said floatable means, for flowing a blended plurality of substances from said blender means into a hole located below water upon which said floatable means is transporting the system.

4. A system as defined in claim 1, wherein said storage means includes:

first bin means for holding a reserve quantity of the particulate material carried on said floatable means; and second bin means for providing a storage interface between said first bin means and said surge bin means, said second bin means having inlet means for receiving particulate material from said first bin means and having outlet means for communicating with said conveying means.

5. A system as defined in claim 1, wherein said means for transferring includes:

conveyor belt means for moving particulate material received from said surge bin means towards an end of said conveyor belt means communicating with said blender means; and gate means for adjustably defining an opening adjacent said conveyor belt means through which the particulate material must pass before being communicated to said blender means so that the maximum crosssectional area of the particulate material moved to said end of said conveyor belt means is defined, said gate means including:

a piston housing;

a piston movably disposed within said piston housing, said piston having a piston rod having an end extending beyond said piston housing;

a screed connected to said end of said piston rod; and support means for supporting said piston housing above said conveyor belt means.

6. A system as defined in claim 1, wherein:

said floatable means includes a hull having a lower deck and an upper deck; and said storage means includes:

a first bin disposed on said lower deck;

a second bin disposed on said upper deck; and conduit means for communicating particulate material between said first and second bins.

7. A system as defined in claim 6, wherein:

said blender means includes a tub disposed on said upper deck;

said surge bin means includes a third bin disposed above said upper deck at a height above said tub; and said means for conveying includes:

first conveyor belt means for moving particulate material from a first level to a second level, said first conveyor includes: first conveyor belt means for moving particulate material from a first level to a second level, said first conveyor belt means having a lower horizontal portion, an upper horizontal portion and an elevating portion extending angularly between said lower and upper horizontal portions, said upper horizontal portion communicating with said third bin; and second conveyor belt means for moving particulate material from said second bin to said lower horizontal portion of said first conveyor belt means.

8. A system as defined in claim 1, wherein:

said floatable means includes a deck;

said storage means includes:

a first bin; and first support means, attached to said deck, for supporting said first bin;

said blender means includes:

a tub; and second support means, attached to said deck, for supporting said tub near the bottom of said second support means;

said surge bin means includes:

a second bin; and third support means for supporting said second bin on top of said second support means; and said means for conveying includes:

first conveyor belt means for moving particulate material from a first level to a second level, said first conveyor belt means having a lower horizontal portion, an upper horizontal portion and a elevating portion extending angularly between said lower and upper horizontal portions, said upper horizontal portion communicating with said second bin; and second conveyor belt means for moving particulate material from said first bin to said lower horizontal portion of said first conveyor belt means.

9. A system as defined in claim 8, further comprising means for flowing a blended plurality of substances from said tub, said means for flowing including:

drive pump means for providing a pressurized driving fluid;

fourth support means, attached to said deck, for supporting said drive pump means; and intensifier means, mounted on top of said fourth support means, for pumping the blended plurality of substances in response to said pressurized driving fluid.

10. An integrated blending system which is transportable as a unit from one well site to another and from which is obtained a blend of a plurality of substances, which is for use in a well at a particular well site where the system has been transported, said system comprising:

blend means for producing the blend at the well site;

holding storage means for storing a substance which is one of the plurality of substances used in producing the blend, said holding storage means including;

a plurality of storage compartments connected to said transport means in fixed spatial relationship, each of said storage compartments having a respective outlet;

a bin; and conduit means for defining a flow path for the substance between said bin and said storage compartments;

surge storage means for receiving at least a portion of the substance from said holding storage means;

means for conveying the substance from said holding storage means to said surge storage means, said means for conveying including:

trunk conveyor means for moving the substance into said surge storage means; and branch conveyor means in fixed spatial relation with each said outlet of said storage compartments and said trunk conveyor means, for moving the substance from said storage compartments to said trunk conveyor means;

means for transferring the substance from said surge storage means to said blend means; and unitary transport means, having said blend means, holding storage means, surge storage means, means for conveying and means for transferring mounted thereon, for simultaneously transporting said blend means, holding storage means, surge storage means, means for conveying, and means for transferring to the well.

11. A system as defined in claim 10, further comprising mixing means, mounted on said transport means, for producing a mixture of at least a second substance and a third substance and for providing the mixture to said blend means.

12. A system as defined in claim 11, further comprising pump means, mounted on said transport means, for pumping the blend from said blend means to the well.

13. A system as defined in claim 10, wherein said holding storage means further includes:

another plurality of storage compartments connected to said transport means in fixed spatial relationship with said means for conveying, each of said another plurality of storage compartments having a respective outlet;

another bin; and another conduit means for defining a flow path for the substance between said another bin and both pluralities of storage compartments.

14. A system as defined in claim 13, wherein:

said means for conveying further includes another branch conveyor means, connected to said transport means in fixed spatial relation with each said outlet of said another plurality of storage compartments and said trunk conveyor means, for moving the substance from said another plurality of storage compartments to said trunk conveyor means; and the first-mentioned branch conveyor means and said another branch conveyor means have respective portions disposed in fixed overlying relationship with said trunk conveyor means.

15. A system as defined in claim 14, wherein:

said transport means includes an ocean-going vessel having an upper support surface and a lower support surface;

the first-mentioned bin and said another bin are positioned on said lower support surface and the first-mentioned plurality of storage compartments and said another plurality of storage compartments are positioned on said upper support surface;

the first-mentioned conduit means includes a first pipe extending from the first-mentioned bin up through said upper support surface and over the first mentioned plurality of storage compartments and said another plurality of storage compartments to first pipe outlets, each of said first pipe outlets communicating with the interior of a respective one of said compartments; and said another conduit means includes a second pipe extending from said another bin up through said upper support surface and over said another plurality of storage compartments and the firstmentioned plurality of storage compartments to second pipe outlets, each of said second pipe outlets communicating with the interior of a respective one of said compartments.

16. A transportable integrated system for developing a fracturing fluid at the site of an offshore oil or gas well drilled into the floor beneath a body of water and for pumping the fracturing fluid into the well, said system comprising:

a unitary ocean-going vessel having a lower deck and an upper deck; and a blend producing and pumping facility mounted on said vessel so that said vessel carries all the equipment necessary for producing the fracturing fluid and for pumping the fracturing fluid into the offshore well above which said vessel is located floating at the surface of the body of water, said blend producing and pumping facility including: a blending subsystem mounted on said vessel, including a blender tub connected to said upper deck, said blender tub having an outlet through which a blend of a plurality of substances is provided;

a mixing subsystem mounted on said vessel, including:

a holding tank connected to said upper deck, said holding tank containing a liquid gel concentrate;

a first storage tank connected to said upper deck, said first storage tank containing liquid nitrogen;

means for vaporizing and pumping the liquid nitrogen into the blend provided through said outlet of said blender tub;

a second storage tank connected to said upper deck, said second storage tank containing methanol communicated to the blend provided through said outlet of said blender tub;

a third storage tank connected to said upper deck, said third storage tank containing acid communicated to the blend provided through said outlet of said blender tub;

a fourth storage tank connected to said upper deck, said fourth storage tank containing a liquid additive;

a mixer tub in which said liquid gel concentrate and said liquid additive are mixed, said mixer tub connected to said upper deck for receiving the liquid gel concentrate from said holding tank and the liquid additive from said fourth storage tank; and a housing containing sacks of dry additives, said housing having a hole defined through a floor of the housing and said housing connected above said mixer tub so that the dry additives can be dumped from said sacks through said opening into said mixer tub for mixing with said liquid gel concentrate and said liquid additive;

a proppant subsystem mounted on said vessel, including:

a reserve bin connected to said lower deck, said reserve bin containing a proppant material, an interface bin connected to said upper deck;

a pipe connected between said reserve bin and said interface bin, said pipe defining a conduit through which said proppant material is transferred to said interface bin;

a surge bin connected above said blender tub;

branch conveyor means, disposed below said interface bin, for moving proppant material from said interface bin;

trunk conveyor means, extending between said branch conveyor means and said surge bin, for elevating the proppant material from said branch conveyor means to said surge bin; and metering conveyor means, disposed below said surge bin and above said blender tub, for moving proppant material from said surge bin into said blender tub; and a pumping subsystem mounted on said vessel, including means, connected to said outlet of said blender tub, for pumping the blended plurality of substances from said blender tub into the offshore well.

* * * * *

UNITED STATES PATENT AND TRADEMARK OFFICE

CERTIFICATE OF CORRECTION

PATENT NO. : 4,715,721

DATED : December 29, 1987

INVENTOR(S) : Lonnie R. Walker et al.

It is certified that error appears in the above-identified patent and that said Letters Patent is hereby corrected as shown below:

In column 9, line 32, delete the word [teh] and insert therefor --the--.

In column 11, line 1, delete the word [floatablemeans] and insert therefor --floatable means--.

Signed and Sealed this

Thirtieth Day of August, 1988

*Attest:*

DONALD J. QUIGG

*Attesting Officer*

*Commissioner of Patents and Trademarks*